United States Patent [19]

Westerlund

[11] 4,101,406

[45] Jul. 18, 1978

[54] SIMPLIFIED ELECTROLYTIC SYSTEM

[75] Inventor: G. Oscar Westerlund, Vancouver, Canada

[73] Assignee: Gow Enterprises Limited, Vancouver, Canada

[21] Appl. No.: 811,238

[22] Filed: Jun. 29, 1977

Related U.S. Application Data

[63] Continuation-in-part of Ser. No. 693,888, Jun. 8, 1976, Pat. No. 4,052,287.

[30] Foreign Application Priority Data

Apr. 1, 1976 [CA] Canada ..... 249382

[51] Int. Cl.[2] ..... C25B 15/08; C25B 9/00

[52] U.S. Cl. ..... 204/239; 204/270; 204/268

[58] Field of Search ..... 204/237, 239, 275–278, 204/270, 268

[56] References Cited

U.S. PATENT DOCUMENTS

| | | | |
|---|---|---|---|
| 3,539,486 | 11/1970 | Fleck | 204/237 X |
| 3,732,153 | 5/1973 | Harke et al. | 204/270 X |
| 3,948,748 | 4/1976 | Messner et al. | 204/270 |
| 3,997,414 | 12/1976 | Casson et al. | 204/270 X |

*Primary Examiner*—John H. Mack
*Assistant Examiner*—D. R. Valentine
*Attorney, Agent, or Firm*—Millen & White

[57] ABSTRACT

A novel electrolytic system, especially suitable for chlorate manufacture, is provided constituted by a novel electrolyzer and a novel reactor. The electrolyzer is designed for multicell assembly employing sheet metal electrodes and includes construction specially designed to hold the electrodes in place and to minimize internal liquor overflow within the cells. Electrolyte flow from cell to adjacent cell is in one direction only, and electrolyte product flow from cell to adjacent cell is in the opposite direction only. The flooded reactor provides suitable electrolyte retention time, temperature and product composition control, respectively, as well as gas separation with liquor level controlled for flooded electrolyzer system. A pipe riser is employed with liquor interconnection means to cause flow between the electrolyzer and the reactor.

17 Claims, 4 Drawing Figures

SIMPLIFIED ELECTROLYTIC SYSTEM

RELATED APPLICATION

This application is a continuation-in-part of application Ser. No. 693,888 filed Jun. 8, 1976, now U.S. Pat. No. 4,052,287.

BACKGROUND OF THE INVENTION (a) Field of the Invention

This invention relates to an electrolysis system including a bipolar electrolytic cell particularly suitable for the production of metal chlorates, particularly alkali metal chlorates. It relates, more specifically, to an electrolysis system including an improved electrolytic cell and apparatus containing multiple unit cells.

(b) General Description of the Prior Art

It is well known that alkali metal chlorates may be prepared by electrolysis of an aqueous solution of an alkali metal chloride. This process has been fully described in Canadian Pat. No. 741,778 issued Aug. 30, 1966 to G. O. Westerlund.

This simplified reaction in the aforesaid electrolysis may be summarized as:

$$MtCl + 3H_2O + 6\ \text{Faradays} \rightarrow MtClO_3 + 3H_2$$

(wherein Mt is a metal). The main reactions in the electrolytic preparation of the metal chlorate from the metal chloride may be represented as follows:

Primary Reactions (A) at the anode:

$$2MtCl \rightarrow 2Mt^+ + 2Cl^- \rightarrow Cl_2 + 2e^- + 2Mt^+ \quad (1)$$

(B) at the cathode:

$$2H_2O \rightarrow 2H^+ + 2OH^- + 2e^- \rightarrow H_2 + 2OH^- \quad (2)$$

Secondary Reactions $$\text{(C)}\ Cl_2 + OH^- \rightarrow ClOH + Cl^- \quad (3)$$

$$ClOH \rightleftarrows H^+ + OCl^- \quad (4)$$

$$\text{(D)}\ 2ClOH + ClO^- \rightarrow ClO_3^- + 2Cl^- + 2H^+ \quad (5)$$

The primary reactions take place in the electrolyzer. The secondary reactions yield products in the electrolyzer but for maximum efficiency a reacting zone is necessary with interflow of active electrolyte for control of pH and to promote chlorate producing reaction (5) by the retention time which is provided by reacting volume. The art of producing chlorate at high efficiency is, as is well known, dependent upon the design of the system to facilitate proper channelling of electrolyte in order to provide maximum reacting time.

As is now well known, metal electrodes are useful in such electrolytic cells. One problem in employing metal electrodes in both monopolar and bipolar electrolytic cells is primarily that, because of the cost of the electrodes, electrode thicknesses are normally minimized. Also, in order to minimize power consumption, the cell gap is frequently quite small; e.g., a metal electrode suitable for chloride electrolysis may be a relatively thin sheeting of titanium, for example, about 0.5 to about 3 mm, which is surface coated on each face to provide the best anode and in some cases cathode surfaces, respectively. This coating may be from only a few microns to a few hundred microns in thickness. The optimum electrolytic cell gap for electrodes for this type and for the manufacture of, e.g., chlorate, will depend upon many factors, for example, the surface coating of electrodes, the current density, the electrode height, the gas-to-liquor ratio, the electrolyte composition and the temperature. For conventional cell conditions in which, for example, the electrode height is about 200 to about 1500 mm, the current densities are from about 1 to about 4 KA per square meter, the gas/liquor ratio is approximately 1:1, and the optimum cell gap is probably between about 1 and about 10 mm.

Monopolar and bipolar electrolytic cells generally were designed for use with graphite electrodes. The advantages of employing metal electrodes are significant, including the following:

(i) compact cells, because of the use of thin electrodes and a high current density;

(ii) lower power consumption, because of better surface properties, i.e., lower overvoltages, lower resistance in electrode material as well as in the electrolyte due to higher operating temperatures, and smaller average electrode gaps resulting in less voltage drop;

(iii) high operating temperature, thereby minimizing the requirement for heat exchangers in the system to provide temperature control;

(iv) vaporization of a significant amount of water, due to higher operating temperatures, which increase electrolyte and product strength;

(v) clean electrolyte, since metal electrodes can be specified for substantially no significant mechanical erosion and subsequent charging of matter which is suspended in the electrolyte;

and (vi) less foam problems of the electrolyte, since the metal electrodes do not normally add ingredients to the electrolyte which would result in a foam problem which may be the case when employing, e.g., impregnated graphite electrodes.

The art of electrolytical manufacture of chlorates has developed significantly in recent years mainly because of the established excellent performance of the titanium surface-coated anodes referred to above. The electrolytic systems utilizing these anodes, however, generally are mere modifications of conventional apparatus and in most cases, comprise monopolar cell units suspending the anodes from the cell tank cover between steel cathode sheets welded to the cell tank. In recent years, there have been new developments both in the design of electrolytic cells and in the design of the electrodes disposed therein. Both monopolar and bipolar electrode types of systems have been developed, some of which are used in commercial production.

SPECIAL DESCRIPTION OF THE PRIOR ART

Signiicant progress was made in advancing the technology by the feature of module electrodes (H. B. Westerlund, U.S. Pat. No. 3,994,798). Such modules may be described as comprising a plurality of modular bipolar electrode assemblies, each comprising: (1) a plate-like metallic anode formed of anode material; (2) a plate-like metallic cathode formed of cathode material; (3) a generally V-shaped in cross-section median electrode plate formed of titanium or a titanium alloy, interposed between, and connected to, each of the plate-like metallic anode and the plate-like metallic cathode, the median electrode extending below the bottom edge of the plate-like metallic anode and the plate-like metallic cathode; and (4) a plurality of electrically insulating spacer elements projecting outwardly from both side faces of at least the plate-like metallic cathode; and further including at least two median electrodes each interposed between, and connected to, a plate-like metallic anode and a plate-like metallic cathode, with the anodes and cathodes interleaved and spaced apart by the electrically non-conducting spacers, and with adjacent V-shaped median electrode plates in electrical connection with each other and adapted to provide current flow transversely of the assembly, which are disposed in a framework including a plurality of transversely extending titanium support plates within which the upwardly extending slot is accommodated, thereby to cooperate with the electrically connected median electrodes and adapted to provide current flow transversely of the assemblies.

The system of U.S. application Ser. No. 693,888 (G. O. Westerlund) provides an electrolyzer and a reactor. These two component vessels communicate by pipe connections for channelling the total active electrolyte and generated gaseous product from the electrolyzer to the reactor. The driving force for flow is uplift of the gaseous products generated on the surface of the electrodes in the electrolyzer. These gases are discharged from the header of the reactor. The degasified liquor, after appropriate retention time by volume design, adjustment in chemical composition and cooling for temperature control, is channelled back to the electrolyzer for regeneration of new products.

SUMMARY OF THE INVENTION (a) Aims of the Invention

However, it would be desirable to improve even more the system above described. Consequently, it is an object of this invention to provide a simplified, more economical such electrolyzer/reactor/degasifier system.

(b) Statement of Invention

Accordingly, by this invention, a closed loop system is now provided for effecting an electrolysis reaction and for subsequently removing reacted products of electrolysis, including: (1) a multicell electrolyzer in the form of a generally rectangular parallelepiped vessel and comprising (A) inlet means for fresh electrolyte thereto, and outlet means for electrolyte soluble ion and gaseous products of electrolysis therefrom, inlet means for recycled electrolyte and electrolyte soluble ion products of electrolysis thereto and outlet means for electrolyte soluble ion products of electrolysis therefrom; (B) a plurality of interconnected electrolytic cells provided with bipolar metal electrode modules disposed in the path of the electrolyte flow between the fresh electrolyte inlet means and the electrolyte soluble ion and gaseous electrolysis products outlet means, one end wall providing anodic end connectors, the other end wall providing cathodic end connectors, with an anode bus bar connected to the anodic end connectors, and a cathodic bus bar connected to the cathodic end connectors, wherein the electrolyte soluble ion and gaseous electrolysis products outlet means are from an electrolytic cell whose electrical potential is the same as that of an electrolytic cell to which the recycled electrolyte and electrolyte soluble ion products of electrolysis return, the cover of the electrolyzer sloping to provide increasing cross-sectional area in the direction from the fresh electrolyte inlet means to the electrolyte soluble ion and gaseous electrolysis products outlet means, the floor of the electrolyzer sloping to provide decreasing cross-sectional area in the direction from recycled electrolyte and electrolyte soluble ion products of electrolysis inlet means to the electrolyte soluble ion products of electrolysis outlet means; (C) a downwardly sloping front wall; (D) wedge means disposed between the electrodes and the front wall, thereby to hold the electrodes in place, and when thus assembled, to simplify installation and to minimize spacing between electrodes; (E) removable cover means to provide the sloping cover; (F) a lower liquor distributing trough connected to the recycled electrolyte and electrolyte soluble ion products of electrolysis inlet means and disposed below the assembled bipolar electrode modules for distributing liquor to the interelectrode zones between the electrodes; (G) a top liquor distributing channel disposed above the assembled electrode modules and leading directly to the electrolyte soluble ion and gaseous electrolysis products outlet means; and (H) circulation means provided by internal pumping action due to the construction and arrangement of the electrodes and the rising gaseous products of the electrolysis; and (2) a reactor/degasifier in the form of a generally upright cylindrical vessel and including (A) inlet means for electrolyte soluble ion and gaseous electrolysis products from the electrolyzer and outlet means near the bottom of the reactor for recycled electrolyte and electrolyte soluble ion products of electrolysis to the electrolyzer, (B) a pipe riser connected directly to the inlet means and discharging near the top thereof, (C) degasifier means disposed atop the reactor means, the degasifier means including an upper liquor-free zone having outlet means for the separated gaseous products of the electrolysis and having an open bottom communicating with, or being, an opening at the top of the reactor for the introduction of electrolyte soluble ion and gaseous electrolysis products into the degasifier means and for the recirculating of largely degasified electrolyte and electrolyte soluble ion products of electrolysis into the reactor, and (D) indirect cooling means for the reactor.

Other Features of the Invention

By one feature of this invention, the electrolyte soluble ion and gaseous electrolysis products outlet means from, and the recycled electrolyte and electrolyte soluble ion products of electrolysis inlet means to, the electrolyzer are from, and to, the same electrolytic cell.

By another feature of this invention, the electrolyte soluble ion and gaseous electrolysis products outlet means are from the anode end of one terminal downstream electrolytic cell, and the recycled electrolyte and electrolyte soluble ion products of electrolysis inlet means are to the cathode end of a different terminal upstream electrolytic cell.

By still another feature of this invention, the fresh electrolyte inlet means are at the end of the electrolyzer, and the electrolyte soluble ion products of electrolysis outlet means are also at the end of the electrolyzer.

By yet another feature of this invention, the electrolyzer comprises a longitudinally extending rectangular parallelepiped vessel, the reactor/degasifier comprises an upright right cylindrical vessel, the reactor/degasifier is disposed at the downstream end of the electrolyzer, the electrolyte soluble ion and gaseous electrolysis products outlet means extends longitudinally from an end wall of the electrolyzer to a cylindrical side wall of the reactor/degasifier, and the recycled electrolyte and electrolyte soluble ion products of electrolysis outflow means extends from a cylindrical side wall of the reactor/degasifier longitudinally to the end wall of the electrolyzer.

By still another feature of the invention, the electrolyzer comprises a pair of separate parallel longitudinally extending rectangular parallelepiped vessels and the reactor/degasifier comprises an upright cylindrical vessel, with the fresh electrolyte inlet means being to the cathodic end of a first such electrolyzer, the electrolyte soluble ion and gaseous electrolysis products outlet means extending longitudinally from an anodic end wall of the first such electrolyzer to a cylindrical side wall of the reactor/degasifier, and the recycled electrolyte and electrolyte soluble ion products of electrolysis outflow means extending longitudinally from a cylindrical side wall of the reactor/degasifier to a cathodic end wall of the second such electrolyzer and the electrolyte soluble ion products of electrolysis outlet means is from the anodic end wall of the second such electrolyzer.

By yet another variant of the invention, the electrolyzer vessel is taller than the electrode height to provide a trough for the recycled electrolyte and electrolyte soluble ion products of electrolysis at the bottom thereof and a channel for fresh electrolyte and the electrolyte soluble ion and gaseous electrolysis products at the top thereof, the trough being defined by a semi-cylindrical bottom of the electrolyzer and a semi-circular cradle upon which the electrodes rest, the bottom trough providing a distributor for the recirculation of the recycled electrolyte and electrolyte soluble ion products of electrolysis fed from the return flow pipe, the channel at the top providing a header for the withdrawal of products of electrolysis to the product outflow pipe.

By still another feature of this invention, the indirect cooling means for the reactor/degasifier includes water heat exchanger coils projecting downwardly centrally within the reactor/degasifier.

By a further feature of this invention, the indirect cooling means for the reactor/degasifier includes an enclosure therearound and means for circulating cooling air within such enclosure.

By another feature of this invention, the inlet means to the reactor/degasifier is vertically aligned with the outlet means from the reactor/degasifier.

By yet a further feature of this invention, the inlet means to the reactor/degasifier is vertically offset from the outlet means from the reactor/degasifier.

By another variant of the invention, the pipe riser for the gas lift may be disposed externally of the reactor, the pipe riser discharging into inlet means at the top of the reactor, or discharging into an inlet means near the bottom of the degasifier.

BRIEF DESCRIPTION OF THE DRAWINGS

In the accompanying drawings

DESCRIPTION OF PREFERRED EMBODIMENTS

Figure 1:
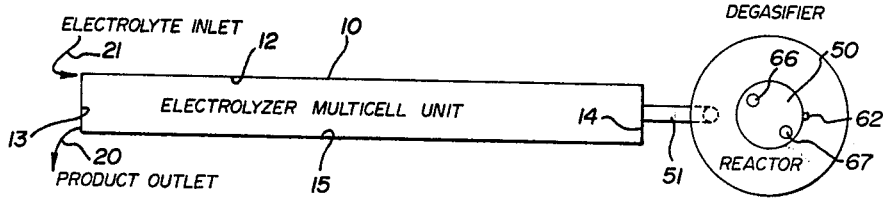
FIG. 1 is a top plan view, partially broken away, of an electrolytic system according to one embodiment of this invention.
Figure 2:
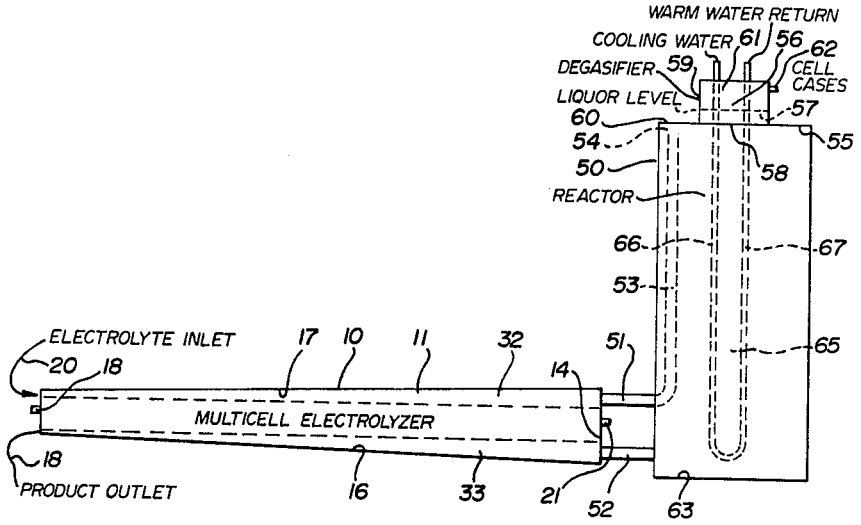
FIG. 2 is a side elevational view, partially broken away and in phantom, of the embodiment of FIG. 1.
Figure 3:
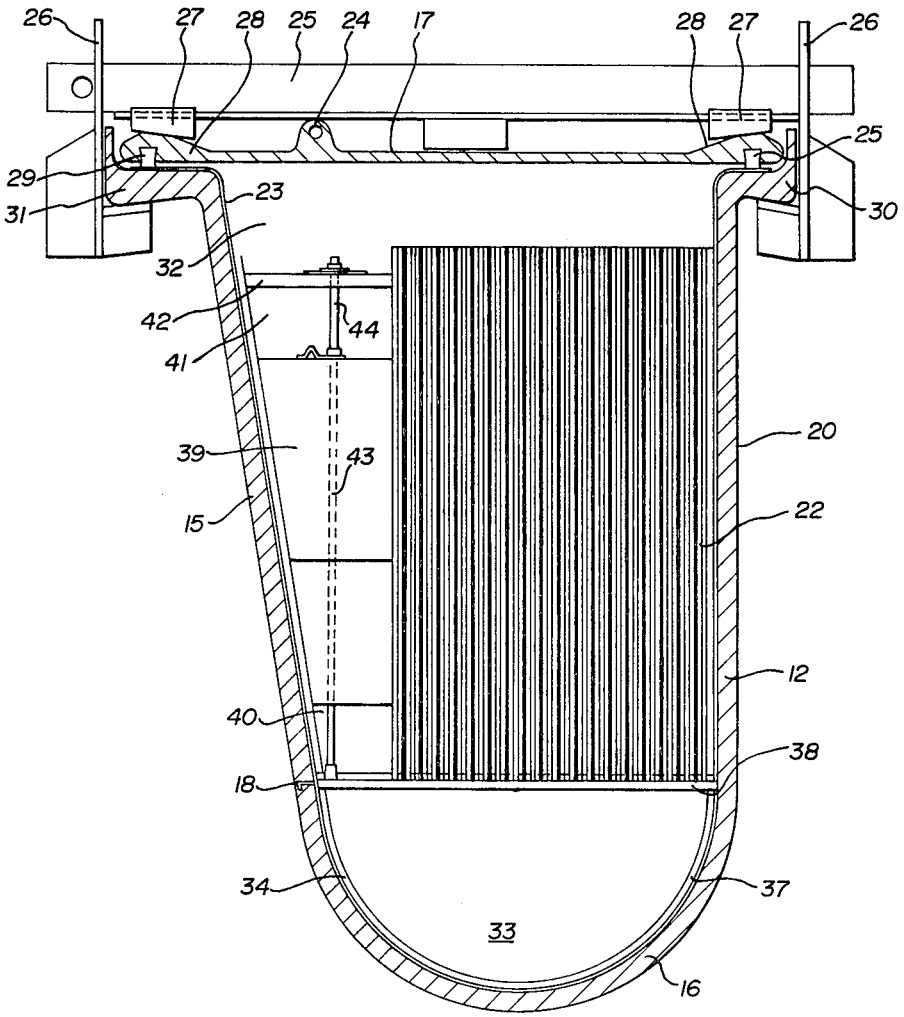
FIG. 3 is a section along the line III—III of FIG. 2.

Description of FIGS. 1, 2 and 3

As seen in FIGS. 1, 2 and 3, the electrolytic system includes an electrolyzer 10 and a reactor 50 interconnected by an outflow pipe 51 (for the electrolyte soluble ion and gaseous electrolysis products) and a return flow pipe 52 (for the recycled electrolyte and electrolyte soluble ion products of electrolysis).

The electrolyzer 10 is generally a rectangular parallelepiped box-like vessel 11 but includes, in addition to a back wall 12, cathode end cell 13 and anode end cell 14, and a downwardly sloping front wall 15. It is also provided with a sloping semi-cylindrical floor 16 and a sloping top cover 17. Cathode end cell 13 is connected to a cathode source (not shown) by means of a longitudinally extending cathode bus bar 18. Similarly, anode end cell 14 is connected to an anode source (not shown) by a longitudinally extending anode bus bar 21.

As seen in FIG. 3, the electrodes 22 are disposed and mounted within the electrolyzer 10 and are spaced from the bottom wall 16 and the top cover 17. The electrodes 22 are preferably interleaved anode/cathode segments and an especially preferred one being of the module type as disclosed and claimed in U.S. Pat. No. 3,994,798. The bipolar electrode 22 includes a generally plate-like metallic anode, a generally plate-like metallic cathode separated by, and connected to, an upstanding median metallic electrode having a generally U-shaped cross-section, and constituted by a pair of spaced-apart legs, each having a lateral wing extending therefrom, by which the median electrode is connected to the anode and cathode.

The material for the anode is a "suitable anodic material", namely, a material that is electrically conductive, resistant to oxidation, and substantially insoluble in the electrolyte, Titanium, with a coating of platinum and iridium is the preferred material, but it would also be possible to use, e.g., ruthenium, and alloys of two or more of the noble metals, or oxides of such metals.

The material for the cathode is a "suitable cathodic material", namely, a material which is electrically conductive, substantially insoluble in the electrolyte under cathodic conditions, resistant to reduction, and either substantially impermeable with respect to $H_2$, or if permeable by $H_2$, dimensionally stable with respect to $H_2$. Steel is the conventional material, but it would also be possible to use titanium, chromium, cobalt, nickel, or alloys of the above metals. At least the cathode is provided with a plurality of spaced-apart electrically non-conductive spacer rods which project outwardly from both flat faces of the cathode.

The median member of the electrode module is preferably made of titanium or a titanium alloy. This facilitates the conducting of electric power longitudinally from the cathode plate to the anode plate. The median members of a cell may all be in direct intercontact, and thus may conduct electric power transversely through the electrolytic cell when fitted in an electrolyzer 10 in the form of a module to lower the potential differences between modules of fitted assemblies. This tends to improve overall voltage for the electrolyzer 10.

The anodes employed are preferably of titanium, which are surface-coated with noble metals, or noble metal oxides to provide the anodic function. Similarly, the cathodes employed are preferably of powdered pressed sintered titanium, which may desirably be surface-coated or treated to improve their performance as a cathode. One such treatment may be partial hydriding; another such treatment may be a coating of $MoS_2$.

The cathode plate is preferably equipped with spacers. These spacers are designed to provide the proper cell spacing when the electrode module is fitted in the cell. A suitable spacer is made of polyvinyl dichloride (PVDC). Other suitable electrically non-conductive plastics materials are those known by the Trade Marks of Kynar, Kel-F or Teflon. The spacers may be produced by employing extruded rods which are slightly less in diameter than the holes punched in the cathode with a length cut to yield the desired protrusion on the sheets. If the spacers are made of PVDC, the cathode plate is heated at about 300° C. for about 2 minutes; the PVDC rods swell to form the spacers at the same time as it longitudinally shrinks. Normally the spacers protrude from about 1 to about 5 mm. The number of spacers required depends on the flatness of the electrode plates and the desired spacing. For example, for standard steel cathodes about 2 mm thick with spacing of about 3 mm required approximately 100 mm between spacer rods. Although it is preferred to apply the spacer rods to the cathodes, they may equally well be applied to the anodes. The spacers may be molded onto the electrode module sheets in any desirable pattern, e.g. using a synthetic rubber.

The assembly of interleaved anode/cathode electrodes provides a plurality of bipolar electrolytic cells. The electrodes are also maintained within the electrolyzer by means of a compression wedge assembly including a central wedge 39, a lower support plate 40, an upper support plate 41, a seal plate 42 and a vertical connecting rod 43 held in place by a threaded nut engagement 44. Wedge 39 is disposed between the vertically standing electrodes 22 and the sloping front wall 15. Wedge 39 has a dual function, namely: (i) it provides a means for holding the electrodes 22 in place during operation, and (ii) by its shape it provides space in the electrolyzer 10 for the installation of all the electrodes 22 with ease, i.e., when the wedge is out. The assembled wedge system also provides a holding means for the seal member which prevents liquor flow to short channel internally of the cells, which would cause less flow to the reactor.

The electrodes rest on bottom plate-like cell dividing system 38 supported by a plurality of structural profile cradles 37 including a lower semi-circular structural portion 34. The support system 38 and cradle system 37 which are preferably of titanium, elevate the electrodes 22 from the bottom of the electrolyzer 10 to provide a lower trough 33. The cross-sectional area of the lower trough 33 preferably decreases in the direction of flow of the recycled electrolyte and electrolyte soluble ion products of electrolysis in order to minimize current leakage.

The electrodes 22 are held in place by the compression wedge system and are thus disposed within the electrolyzer 10 to be spaced from the top cover 17 to provide a top channel 32. The cover 17 is clamped to the top of the electrolyzer 10 by resting on forward flange 31 and rear flange 30 with gaskets 29 therebetween, the cover including camming projections 28, adapted to be engaged by slidable wedges 27. The flanges 31 and 30 are provided with vertical guides 26 and clamping of the cover 17 is provided by cover clamp device 25. Cover 17 is provided also with cover lifting lug 24. The cross-sectional area of the top channel 32 increases with the flow direction of the electrolyte soluble ion and gaseous electrolysis products, in order to minimize current leakage.

Thus FIG. 3 shows clearly how the top cover 17 is mounted on the top of the electrolyzer 10. It is seen that the upper edge of the front wall 15 and the rear wall 12 of the electrolyzer 10 are provided with a tray (provided by flanges 30, 31) to minimize the spillage of liquor in case of a leak, as well as to provide structural rigidity. The cover 17 is spaced from the tray by a gasket 29 and is clamped in place by an "L"-shaped clamp 25, 26 engaging the tray flanges 31, 30 and a wedge 27 slidably mounted on a cross bar. The wedge 27 frictionally locks against a cam 28 of the cover 17; alternatively, clamp bolts may be substituted for the wedges.

It would, of course, be possible to use a simple bolted joint, but, while such joint may be more secure, it is much slower to open and to install, respectively, and does not provide the desired support for the cover.

As described briefly above, a novel procedure and structure has also been adapted to mount the interleaved electrodes 22 between the front wall 15 and the back wall 12. In order to minimize fabrication costs, the electrodes, including the spacers, vary in thickness and the tolerance limits are not set too tightly. Even providing an average tolerance of about 1/10 mm+ for the width for the spacing of assembled electrodes, the width dimensions of a cell employing perhaps 100 interleaved electrode plates would be about 10 mm more than an adjacent cell. This would tend to create difficult problems in installation for conventional electrolyzer designs. The variation in total cell width is compensated by providing wedge system 39 which gives plenty of space for the installation of the electrodes 22. Adjustment for width variation of the assembled interleaved electrodes is provided by vertical movement of the wedge system 39. It is seen that one wedge 39 is provided for each cell. The wedge 39 may be full length of the cell or may extend partially only using a top seal plate 42 (to provide a liquor flow seal) which extends the full length of a cell.

It is seen that this is a significant simplification in the manufacture, and assembly and installation of the electrodes. If the front wall 15 was vertical, the width of the electrolyzer 10 must be wider than the maximum width of assembled cells. The spacer plates would have to be individually installed which will vary from one cell to another. This is slow and requires close tolerance fitting and is more difficult than employing the wedge 39.

The electrolyzer vessel 10 should preferably be constructed of non-conductive material, e.g. polyester resin glass reinforced for structural strength and lined, if desired, with polyvinyl dichloride sheeting 23 or other more chemical-resistant liner (e.g., that known by the Trade Mark of Teflon).

It has been found that contact resistance between two adjacent median electrodes, when fitted in the electrolyzer 10, in the form of a module, depends upon the shape of the median electrode but a range of about 0.1 to about 0.5 ohms per square cm is attainable.

The electrolyzer 10 is, as stated above, connected to the reactor 50 by an outflow pipe 51 for electrolyte, electrolyte soluble ion products of electrolysis and entrained and/or occluded gaseous products of electrolysis (hereinafter termed "intermediate product outflow") and a flow pipe 52 for electrolyte, and electrolyte soluble ion products of electrolysis which have been at least 99% degasifier (hereinafter termed "recycled product return flow").

Intermediate product outflow pipe 51, within reactor 50, is connected directly to pipe riser 53 which includes a discharge opening 54 near the top 55 of the reactor 50. The intermediate product substantially completely fills reactor 50 and flows to a degasifier 56 maintaining a level of liquid interface 57 via communicating opening 58. It should be noted that the pipe riser 53 may be disposed externally of the reactor, and may discharge to the degasifier 56. The degasifier 56 comprises a cylindrical chamber 59 integrated as part of the top cover 60 of the reactor 50, respectively. Occluded cell gases rise to the upper portion 61 of the degasifier 56 and are drawn off by cell gas withdrawal pipe 62. The degasifier 56 should provide sufficient space for any necessary volume increase when starting up the system (usually less than about 25% of the volume between the electrodes is required). Liquor will flow generally downwardly to the bottom 63 to the return flow pipe 52 and thence to the same cell of the electrolyzer 10 as discharges the product. Thus, the liquor in the reactor 50 will have one electrical potential only, providing for the employing of metal material, e.g., titanium, in the construction of the reactor.

The electrolytic process generates heat; about 50 to about 80% of power input is accounted for as heat. To control electrolyte temperature, liquor in the reactor 50 is cooled by indirect heat exchanger means, i.e., a plurality of immersed U-shaped cooling coils 65. Each cooling coil 65 includes a cooling water down tube 66 and connected to a warm water up tube 67. Preferred coils are of titanium tubing but they may also be of other material, e.g., Teflon. The coils may serve a dual purpose, namely: (i) for the cooling of electrolyte, and (ii) for heating the brine, if desired, e.g., when treating for hardness.

It is noted that only a single inlet is provided for fresh electrolyte (brine) into the electrolyzer 10, i.e., via fresh electrolyte inlet tube 21. Only one outlet is provided from the electrolyzer, namely, product outlet tube 20. Muriatic acid may be added to fresh electrolyte inlet tube 21 to control the pH level at the optimum for promoting desirable reaction. In the case of chlorate, the pH should be in the range of about 6 to about 7.5. For control of the liquor level and/or electrolyte composition, the brine is added through the inlet 21 and the product is withdrawn through product outlet 20.

The reactor 50 may be constructed of steel if it is cathodically protected with minimum current flow of about 2 amps per square foot surface on all surfaces; potential more than about 1 volt. A tank lined with titanium or chemically-resistant plastic (e.g. Teflon) would be preferred. Alternatively, a solid titanium construction may be provided.

Figure 4:
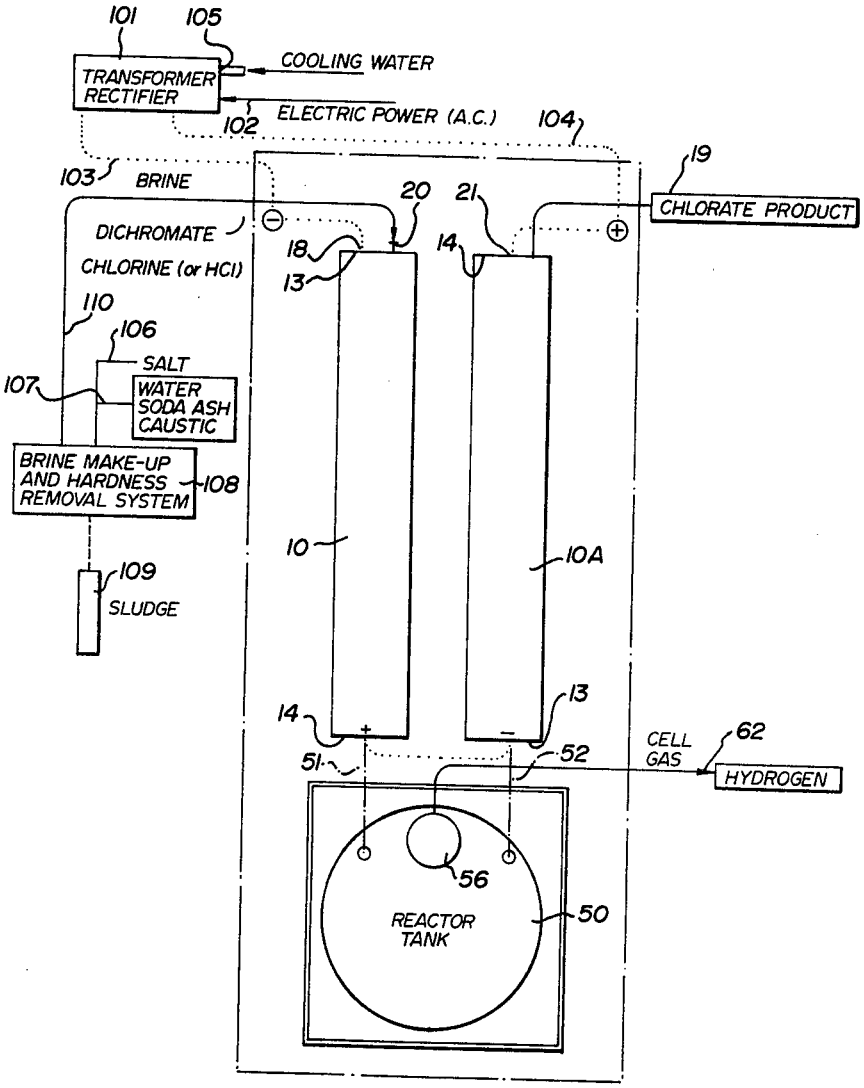
FIG. 4 is a top plan view of an electrolyte system according to a second embodiment of this invention.

Description of FIG. 4

FIG. 4 shows a further embodiment of this invention. Here, two multicell units 10 and 10A are connected in parallel to a single reactor 50. The construction of multicell units 10 and 10A and reactor 50 are as described above.

In the general system, a transformer rectifier 101 converts, in one case, A.C. electric power from line 102 to 110 V, 10,000 amp D.C. power, to be connected to cells 10 and 10A, the negative line 103 being connected to the cathode bus bar 18, and the positive line 104 being connected to the anode bus bar 21. The transformer rectifier is cooled by water in coils 105.

The brine to be electrolyzed is made up of salt in line 106, water, soda ash and caustic in line 107, admitted to a brine make-up and hardness removal system 108. The sludge is discarded at 109, and the brine along with any desired dichromate chlorine or HCl is admitted via line 110 to multicell unit 10 at the cathode end 13 through fresh electrolyte inlet 20. The intermediate product is drawn off via line 51 and led to reactor/degasifier 50 at the anode end 14. The degasified intermediate product returns to multicell unit 10A via line 52 at the cathode end 13. Thus, there is no need to be concerned about voltage drops since, in effect, multicell units 10 and 10A are both of the same electrical potential at the terminal connectors, whose electrolyte has been degasified at its mid point of travel and which is returned at the same point. Chlorate product is withdrawn from multicell unit 10A at the anode end 14 via line 19.

The cell gas (mainly hydrogen) which has been separated from the intermediate liquor in degasifier 56 is withdrawn via line 62 for further use well known to persons skilled in the art.

The reactor/degasifier 50 is shown to be air cooled in this embodiment. The reactor/degasifier 50 is enclosed in a rectangular parallelepiped housing 115 and is air cooled by four fans 116.

Operation of Preferred Embodiment

In order to operate in an essentially non-corrosive manner when operating in an electrolyte, one end of the median electrode will be anodically charged and the other end will be cathodically charged. In performing as a cathode, the titanium will form a hydride and consequently some corrosion may occur especially should the electrolyte temperature be excessive (i.e., above about 90° C.). No visually observed corrosion is noted, when employing structurally rigid titanium powdered pressed sintered cathodes treated with $MoS_2$, even under most adverse operating conditions. In performing as an anode, the titanium would oxidize. No visually observed corrosion has been noted except if the electrical cell potential in commercial grade chloride solution exceeds 9 volts.

In electrolyzers having common channels, where the channels are separate and distinct from the cells, the electrical potential is essentially equalized in the main channels, and current leakage from or to the individual cells is found to be, for practical purposes:

$$I = E/(3R) \times n\text{-}2/(2) \times n/(2)$$

where

I = Amps
E = Electrolyzer Voltage
R = Electrolyte Resistance
$n$ = number of cells Thus, increasing number of cells per electrolyzer drastically increases current leakage. According to this invention, however, it has been found that, if the electrolyte channels are integrated part of the cell, the voltage potential of liquor in the channels is, for practical purposes, equal to the average potential of the cell, and the channel it is communicating with. The current leakage is, in this case, as per Ohms law: $I = e/R$ where $e$ = voltage difference between two cells. Thus, according to this invention, the number of cells in the electrolyzer 10 is not a factor in the current leakage and relatively large channels can be employed without drastically increasing the current leakage due to the relatively low voltage driving force.

In the embodiment of this invention shown in FIGS. 1, 2 and 3, a plurality of electrode assembly modules are very readily made up with essentially no limitations as to capacity since the number of electrode assembly modules fitted longitudinally determines total production output for an electrolyzer. Thus, the electrolyzer 10 may achieve high production capacities (practical range: about 1600 metric tons per year per system shown in FIGS. 1, 2 and 3 at current amperage of about 10,000 and voltage of about 100).

Electrical energy is transmitted by voltage potential drive across the electrolyzer by current conduction to the respective end cell's monopolar electrodes, electrolyte between electrodes and conductance of current from cell to cell longitudinally through the electrode modules.

A pre-assembled electrode assembly, in a cell dividing plate (instead of profile) as, e.g., in Canadian Pat. No. 914,610, can also be employed in this electrolyzer 10 although the simplicity of the module electrode makes it a preferred assembly.

If operating the system batchwise, the brine is for make-up only; if a continuous system, brine is added continuously. If more than one system is employed, they could be operated in series or in parallel as has been described hereinabove in FIG. 4.

The volume of the reactor tank depends on the desired current efficiency; results indicate that current concentration should be approximately 20 amps per liter for an 80% yield and about 6 amps per liter for a 95% yield.

A free flow providing a high rate of circulation between the electrolyzer and the reactor is essential for high efficiency. The non-restricted channels of the cells and the large cross-sectional area of common channels provides for maximum flow from gas product uplifts. The cells are properly sealed to minimize or even substantially avoid internal recirculation, and hence the drive from cells and pipe riser design by the gas lift is sufficient not to require a mechanical pump device; at a current density of about 1 amp/square inch, electrode distance of about 3/16 inch, the pipe riser about 2 feet, the upward velocity is up to about 30 feet per minute. Thus, the system with integrated channelling of liquor/-products, avoiding internal recirculation, provides for recirculation within the system.

The liquor and electrolyte flow may be described as follows: Fresh electrolyte is fed via inlet 12, with or without a pH adjusting amount of muriatic acid, and it travels longitudinally along the top header 32 of the electrolyzer 10 to the intermediate product outflow pipe 51. The liquor flows upwardly through riser pipe 53, to degasifier 56 and then downwardly to the bottom of reactor 50 to return flow pipe 52. Then it flows along bottom trough 33 and upwardly through to the interelectrode spaces between interleaved anode/cathode electrodes 22. The liquor passes upwardly through the interelectrode spaces to the top channel 32. The liquor, including the soluble ion products of electrolysis and occluded gaseous products of electrolysis, then travels longitudinally downstream to the intermediate product outflow pipe 51 to the top of reactor 50 and then to the degasifier 56. There the gas is separated in gaseous space 61 and is drawn off via pipe 62. The liquor then travels downwardly and along the bottom to return flow pipe 52 to be electrolyzed again. Product may be drawn off via line 19 in an amount to maintain substantially constant liquor level including adjustment for the amount of fresh electrolyte admitted through line 20.

SUMMARY

The electrolyzer 10 is thus connected via titanium pipe connections 51, 52 to a vertical reactor 50. The connection is thus inert to the liquor. A return liquor channel is vertical of the height of the reactor since the liquor discharged at the top of the reactor/degasifier 50 and is returned to the electrolyzer 10 from the bottom of the reactor/degasifier 50. The liquor flow is inherently downwardly in the reactor/degasifier 50 due to the uplift by gases in the cell and the pipe riser 53. The liquor discharged from the pipe riser 53 is degasified in the gas zone 61 in the degasifier 56. There is a slow rate of flow of liquor downwardly once it is discharged from the pipe riser 53 into the reactor/degasifier 50 due to the gas release and the enlarged cross-sectional area in the reactor relative to the pipe riser.

Thus, by this invention a novel electrolytic system is provided for chlorate manufacture. The novel combination of the electrolyzer and reactor provides improved economies of manufacture and assembly, and improved efficiencies of operation.

From the foregoing description, one skilled in art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A closed loop system for effecting an electrolysis reaction and for subsequently removing reacted products of electrolysis, including: (1) a multicell electrolyzer in the form of a generally rectangular parallelepiped vessel and comprising: (A) inlet means for fresh electrolyte thereto, and outlet means for electrolyte soluble ion and gaseous products of electrolysis therefrom, inlet means for recycled electrolyte and electrolyte soluble ion products of electrolysis thereto and outlet means for electrolyte soluble ion products of electrolysis therefrom; (B) a plurality of interconnected electrolytic cells provided with bipolar metal electrodes disposed in the path of the electrolyte flow between the fresh electrolyte inlet means and the electrolyte soluble ion and gaseous electrolysis products outlet means, one end wall providing an anodic terminal connection, the other end wall providing a cathodic terminal connection, with an anode bus bar connected to the anode terminal connection and a cathodic bus bar connected to the cathodic terminal connection, wherein the electrolyte soluble ion and gaseous electrolysis products outlet means are from an electrolytic cell whose electrical potential is about the same as that of an electrolytic cell to which the recycled electrolyte and electrolyte soluble ion products of electrolysis return, the cover of said electrolyzer sloping to provide increasing cross-sectional area in the direction from the fresh electrolyte inlet means to the electrolyte soluble ion and gaseous electrolysis products outlet means, the floor of said electrolyzer sloping to provide decreasing cross-sectional area in the direction from recycled electrolyte and electrolyte soluble ion products of electrolysis inlet means to the electrolyte soluble ion products of electrolysis outlet means; (C) a downwardly sloping front wall; (D) wedge means disposed between the electrodes and the front wall, thereby to hold the electrodes in place, and when thus assembled, to simplify installation and to minimize internal liquor spacing between electrodes; (E) removable cover means to provide said sloping cover; (F) a lower liquor distributing trough connected to the recycled electrolyte and electrolyte soluble ion products of electrolysis inlet means and disposed below the assembled bipolar electrode modules for distributing liquor to the interelectrode zones between said electrodes; (G) a top liquor distributing channel disposed above the assembled electrode modules and leading directly to the electrolyte soluble ion and gaseous electrolysis products outlet means; and (H) circulation means provided by internal pumping action due to the construction and arrangement of the electrodes and the rising gaseous products of the electrolysis; and (2) a reactor/degasifier in the form of a generally upright cylindrical vessel and including (A) inlet means for electrolyte soluble ion and gaseous electrolysis products from said electrolyzer and outlet means near the bottom of said reactor for recycled electrolyte and electrolyte soluble ion products of electrolysis to said electrolyzer; (B) a pipe riser connected directly to said inlet means and discharging near the top thereof; (C) degasifier means disposed atop the reactor means, the degasifier means including an upper liquor-free zone having outlet means for the separated gaseous products of electrolysis and having an open bottom communicating with, or being, an opening at the top of said reactor for the introduction of electrolyte soluble ion and gaseous electrolysis products into said degasifier means and for the recirculating of largely degasified electrolyte and electrolyte soluble ion products of electrolysis into said reactor; and (D) indirect cooling means for said reactor.

2. The system of claim 1 wherein the electrolyte soluble ion and gaseous electrolysis products outlet means from, and the recycled electrolyte and electrolyte soluble ion products of electrolysis inlet means to, the electrolyzer are from, and to, the same electrolytic cell.

3. The system of claim 1 wherein the electrolyte soluble ion and gaseous electrolysis products outlet means are from the anode end of one terminal downstream electrolytic cell, and the recycled electrolyte and electrolyte soluble ion products of electrolysis inlet means are to the cathode end of a different terminal upstream electrolytic cell.

4. The system of claim 1 wherein the fresh electrolyte inlet means are at one end of the electrolytic cell, and the electrolyte soluble ion products of electrolysis outlet means are also at such end of the electrolyzer.

5. The system of claim 1 wherein the electrolyzer comprises a longitudinally extending rectangular parallelepiped vessel, the reactor/degasifier comprises an upright right cylindrical vessel, the reactor/degasifier is disposed at the downstream end of the electrolyzer, the electrolyte soluble ion and gaseous electrolysis products outlet means extends longitudinally from an end wall of the electrolyzer to a cylindrical side wall of the reactor/degasifier, and the recycled electrolyte and electrolyte soluble ion products of electrolysis outflow means extends from a cylindrical side wall of the reactor/degasifier longitudinally to the end wall of the electrolyzer.

6. The system of claim 1 wherein the electrolyzer comprises a pair of separate parallel longitudinally extending rectangular parallelepiped vessels and the reactor/degasifier comprises an upright cylindrical vessel, with the fresh electrolyte inlet means being to the cathodic end of a first such electrolyzer, the electrolyte soluble ion and gaseous electrolysis products outlet means extending longitudinally from an anodic end wall of the first such electrolyzer to a cylindrical side wall of the reactor/degasifier and the recycled electrolyte and electrolyte soluble ion products of electrolysis outflow means extending longitudinally from a cylindrical side wall of the reactor/degasifier to a cathodic end wall of the second such electrolyzer and the electrolyte soluble ion products of electrolysis outlet means is from the anodic end wall of the second such electrolyzer.

7. The system of claim 1 wherein the electrolyzer vessel is taller than the electrode height to provide a trough for the recycled electrolyte and electrolyte soluble ion products of electrolysis at the bottom thereof and a channel for fresh electrolyte and the electrolyte soluble ion and gaseous electrolysis products at the top thereof, the trough being defined by a semi-cylindrical bottom of the electrolyzer and a semi-circular cradle upon which the electrodes rest, the bottom trough providing a distributor for the recirculation of the recycled electrolyte and electrolyte soluble ion products of electrolysis fed from the return pipe, the channel at the top providing a header for the withdrawal of products of electrolysis to the product outflow pipe.

8. The system of claim 1 wherein the indirect cooling means for the reactor/degasifier includes water heat exchanger coils projecting downwardly centrally within the reactor/degasifier.

9. The system of claim 1 wherein the indirect cooling means for the reactor/degasifier includes an enclosure therearound and means for circulating cooling air within said enclosure.

10. The system of claim 1 wherein the inlet means to the reactor/degasifier is vertically aligned with the outlet means from the reactor/degasifier.

11. the system of claim 1 wherein the inlet means to the reactor/degasifier is vertically offset from the outlet means from the reactor/degasifier.

12. The system of claim 1 wherein said pipe riser is disposed externally of the reactor, and wherein it discharges into an inlet means at the top of the reactor.

13. The system of claim 1 wherein said pipe riser is disposed externally of the reactor, and wherein it discharges into an inlet means near the bottom of the degasifier.

14. The system of claim 1 wherein the indirect cooling means for the reactor/degasifier also includes means for pumping brine into bring heating means.

15. The system of claim 1 wherein the reactor is constructed of solid titanium material.

16. The system of claim 1 wherein the electrolyzer is constructed with a cell-liquor-inert liner.

17. The system of claim 16 wherein the liner is polytetrafluoroethylene.

* * * * *